United States Patent [19]

King

[11] 4,034,965

[45] July 12, 1977

[54] MATERIAL DISTRIBUTING AND MIXING APPARATUS

[75] Inventor: Leonard Tony King, Long Beach, Calif.

[73] Assignee: Komax Systems, Inc., Carson, Calif.

[21] Appl. No.: 636,713

[22] Filed: Dec. 1, 1975

Related U.S. Application Data

[63] Continuation-in-part of Ser. No. 428,865, Dec. 27, 1973, Pat. No. 3,923,288.

[51] Int. Cl.[2] ..... B01F 15/02

[52] U.S. Cl. ..... 259/4 AB; 259/4 AC

[58] Field of Search ..... 259/4 R, 4 AB, 4 A, 259/4 AC; 138/42; 239/432, 488

[56] References Cited

U.S. PATENT DOCUMENTS

| | | | |
|---|---|---|---|
| 3,051,453 | 8/1962 | Sluijters | 259/4 AB |
| 3,652,061 | 3/1972 | Chisholm | 259/4 AC X |

*Primary Examiner*—Edward J. McCarthy

*Attorney, Agent, or Firm*—Limbach, Limbach & Sutton

[57] ABSTRACT

Apparatus for mixing or distributing a material or materials having no moving parts in which one or more elements are fitted into a conduit. Substantial radial displacement of material flowing in the conduit is achieved over a short distance with minimum pressure drop. Each element initially imparts a rotational vector to the material stream and then transforms the rotational vector to a lateral or radial vector.

3 Claims, 12 Drawing Figures

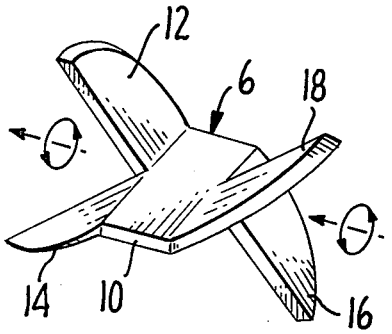
FIG. 1.
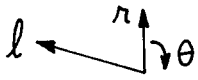
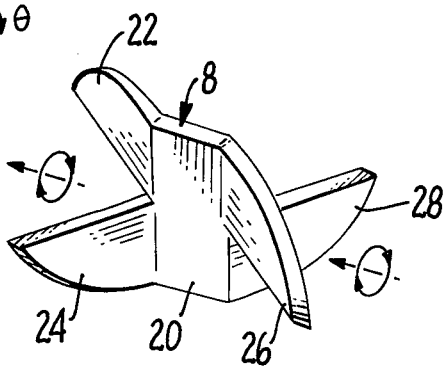
FIG. 2.
FIG. 4.
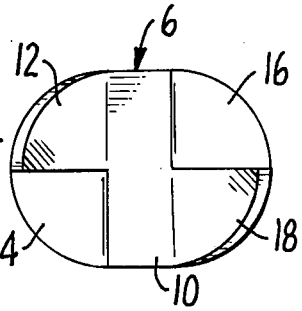
FIG. 3.
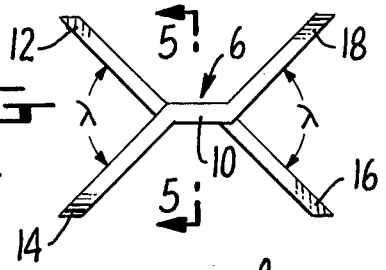
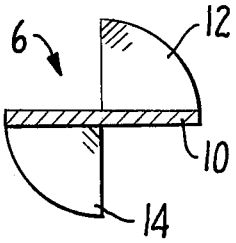
FIG. 5
FIG. 7.
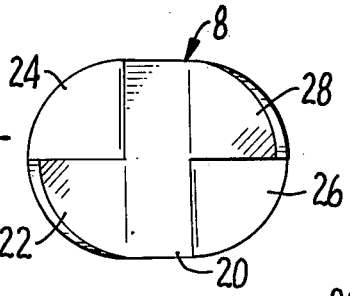
FIG. 6.
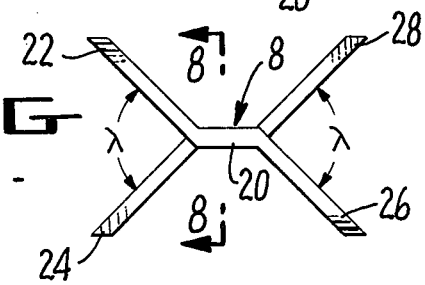
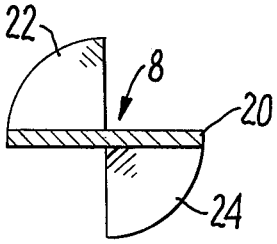
FIG. 8.

MATERIAL DISTRIBUTING AND MIXING APPARATUS

BACKGROUND OF THE INVENTION

This invention relates to material distributing and mixing apparatus and particularly to stationary material distributing and mixing apparatus. Such stationary material mixing apparatus of different construction also have been known in the prior art variously as static mixers and interfacial surface generators.

Several varieties of prior art mixing apparatus are known and disclosed in the following U.S. Pat. Nos. 1,874,002; 3,051,452; 3,051,453; 3,182,965; 3,195,865; 3,206,170; 3,239,197; 3,286,992; 3,328,003; 3,358,749; 3,394,924; 3,404,869; 3,406,947; 3,583,678; 3,635,444; 3,643,927; 3,652,061; 3,664,638; 3,704,006; 3,733,057; and 3,751,009. Also of interest is French Patent No. 735,033 (1932). All of the above patents are herewith incorporated by reference. My prior copending application Ser. No. 428,865, is also incorporated herein by reference.

The prior art approaches typically involve expensive machining, molding, casting or other fabrication of the component mixer elements coupled with some type of permanent attachment between elements and a conduit. The resulting cost and difficulty of manufacture results in a relatively expensive end product. Moreover, many of the prior art mixers provide less than complete mixing and distributing particularly with respect to material flowing along the walls of the conduit. This so-called "wall-smearing"is related to the parabolic velocity profile of a fluid having laminar flow in a pipe: the fluid velocity is small or zero along the wall surfaces.

In applicant's above identified parent application, a plurality of self-nesting, abutting and axially overlapping elements are fitted into a conduit. While such a configuration is highly desirable where complete mixing of different materials is required, it has been found that certain applications require only a single element or alternatively, that the elements can be spaced apart and yet achieve results adequate for the application.

For example, where a substantial radial displacement of material flowing in a tube or pipe is required in as short a distance as possible with minimum pressure drop, the single mixing element according to the present invention is highly desirable.

A typical application for the single element is the equalization of temperature distribution in a heating or cooling application.

The invention is applicable not only to the mixing of two or more unlike materials but also the the re-distribution of a single material for thermal or other purposes. SUMMARY OF THE INVENTION In accordance with the teachings of the present invention a stationary material mixing apparatus is provided comprising one or more elements fitted into a conduit. The elements can be inexpensively fabricated by punch pressing from flat sheets. The elements provide a close fit to the conduit walls when a slight "spring" is provided in the elements. No permanent connection between elements and the conduit wall is required but may be provided if desired. Thus, the conduit can be a flexible tube if required for a given application.

When combined with a material distribution head, particularly one with a coaxial feed, the mixing apparatus can be disposable to avoid any necessity to clean the apparatus after use with reactive materials.

As materials enter the element region a rotational vector is applied to the fluid stream by the oppositely bent ears. The subsequent flat region of the element causes the rotational vector to be transformed into a lateral or radial vector. The further set of bent ears imparts some additional lateral or radial vector and permits bilateral operation of the element so that materials can be passed in either direction through the conduit.

The inventive apparatus is useful for mixing and distributing virtually any materials including liquids, solids, gases, foams, etc.

Further advantages of the invention will be noted in the following detailed description.

BRIEF DESCRIPTION OF THE DRAWINGS

FIG. 1 is a perspective view of an arbitrarily designated "left-hand" element according to the invention.

FIG. 2 is a perspective view of an arbitrarily designated "right-hand" element according to the invention.

FIG. 3 is a side elevational view of the "left-hand" element of FIG. 1.

FIG. 4 is a plan view of the "left-hand" element of FIG. 1.

FIG. 5 is a sectional view along lines 5—5 of FIG. 3.

FIG. 6 is a side elevational view of the "right-hand" element of FIG. 2.

FIG. 7 is a plan view of the "right-hand" element of FIG. 2.

FIG. 8 is a sectional view along lines 8—8 of FIG. 6.

DESCRIPTION OF THE PREFERRED EMBODIMENTS

Figure 9:
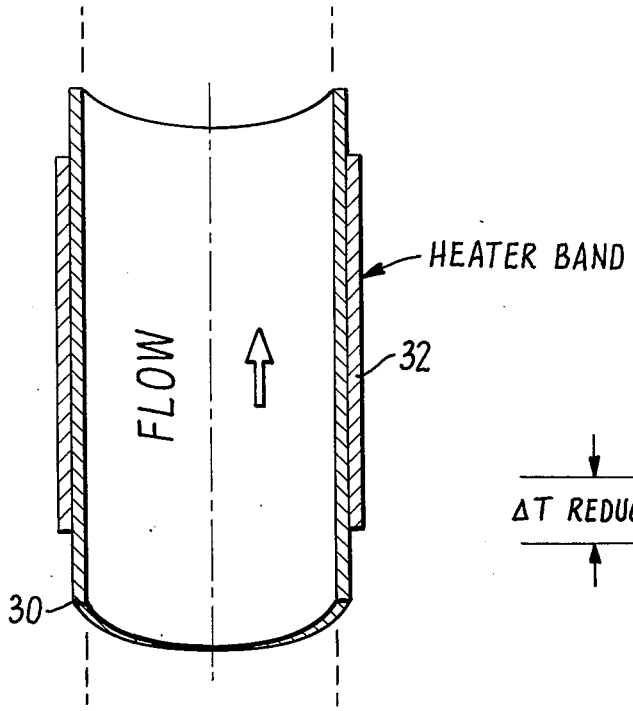
FIG. 9 is a cut away plan view along the axis of a conduit carrying a fluid flow having a heater band on its outside periphery.

Referring now to FIGS. 1 — 8 wherein the stationary material distributing and mixing apparatus is shown.

The elements 6 and 8 are intended to be fitted within a right circular cylindrical tube or conduit (not shown) having an axis along the leftward pointing arrows of FIGS. 1 and 2. Therefore, the cylindrical coordinate system will be used throughout this specification. As is well known, in the cylindrical coordinate system, a point is defined by l, r and $\theta$ where l is the longitudinal coordinate, r the radial coordinate with reference to the longitudinal axis, and $\theta$ the angular coordinate in a plane normal to the longitudinal axis.

Although the present invention is shown and described with reference to use in a right circular cylindrical conduit, it is to be understood that the invention is applicable to other configurations including chambers having a rectangular cross section. Moreover, the longitudinal axis of the chamber need not be a straight line, but may be curved due to the nature of the elements 6 and 8 as will become more apparent hereinafter.

Element 6, shown in greater detail in FIGS. 1 and 3 — 5, is arbitrarily designated a "left-hand" element and is a mirror image of element 8, shown in greater detail in FIG. 2 and 6 — 8, and arbitrarily designated a "right-hand" element.

Element 6 includes a central flat portion 10 the plane of which is intended to be generally aligned with the longitudinal axis of the conduit in which it is placed. First and second ears 12 and 14, rounded or otherwise configured at their outside peripheries for a general fit to the wall of chamber 4, are bent upward and downward from the flat portion 10. A second pair of ears 16 and 18 at the opposite side of flat portion 10, are bent downward and upward, respectively. The outside peripheral edges of ears 16 and 18 are also rounded or otherwise configured for a general fit to the wall of chamber 4.

Elements 6 and 8 may be formed from a single flat sheet by a punch press, for example. However, the invention is not limited to any particular manner of fabrication, nor is the invention limited to providing elements 6 and 8 as a unitary piece. For example, elements 6 and 8 could each be a plurality of pieces brazed, soldered, welded or otherwise fastened together. It will be apparent, however, that the configuration of elements 6 and 8 makes possible their manufacture out of single sheets extremely inexpensively.

Element 8 is a mirror image of element 6 and in a similar manner includes a central flat portion 20, a first pair of ears 22 and 24 and a second pair of ears 26 and 28.

The angle λ between ears 12 – 14, 16 – 18, 22 – 24 and 26 – 28, best seen in FIGS. 3 and 6, is preferably in the range of about 30° to 120° with an angle of 90° being shown as one example. Obviously the extremes of 0° and 180° provide ultimate limits.

An element 6 or 8 may be used singly in a conduit Alternately, more than one element 6 or 8 may be used, spacing the elements apart or abutting them, as described in the above identified parent application.

The ears (12, 14, 16, 18, 22, 24, 26, 28) are preferably dimensioned to "spring" against the conduit wall so that a good fit is made to the wall without any need for brazing, gluing or otherwise permanently fixing each element 6 and 8 to the chamber 4 wall.

Referring to FIG. 1, with respect to materials moving longitudinally in the direction of the longitudinal axis 1, a counter-clockwise velocity vecotr or rotational vector is imposed by ears 16 and 18 of element 6. The flat portion 10 transforms the rotational vector to a lateral or radial vector. Subsequent to the flat portion 10, ears 12 and 14 impose a further counterclockwise velocity vector adding somewhat to the lateral or radial vector. It will also be noted that ears 16 and 18 impose a substantially inward directed radial velocity vector on materials moving longitudinally, whereas ears 12 and 14 impose a substantially outward directed radial velocity vector. In a similar manner in FIG. 3, ears 26–28 and 22–24 impose both a clockwise rotating velocity vector and impose generally inward and outward radial vector, respectively.

Referring again to the stationary material distributing and mixing apparatus of FIGS. 1 – 8, it will be appreciated that the invention is useful for mixing and distributing all types of materials including liquids, solids, gases, foams, etc. Because elements 6 and 8 preferably are not permanently fastened to each other or to the chamber 4 walls, the conduit 2 can be a flexible material so that the apparatus can take various curved shapes as may be required in particular applications.

In addition to providing mixing functions, the invention is useful in re-distributing a single type of material within a conduit. Such an application is in heating or cooling apparatus.

Figure 10:
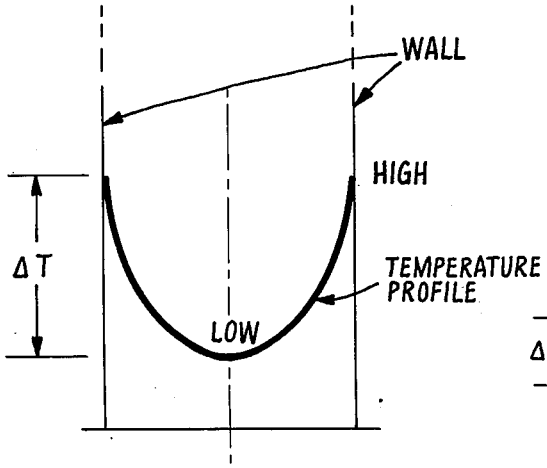
FIG. 10 is a temperature profile of the fluid in the conduit of FIG. 9.

FIG. 9 shows a conduit 30 having a heating band 32 attached to its periphery. A typical temperature profile of a material flowing through conduit 30 is shown in FIG. 10. Due to the normal velocity distribution across the conduit, a large temperature distribution exists across the diameter of the conduit. The substantial temperature variation results from the familiar "wall-smearing" effect as a fluid flows through a pipe: velocity is slower at the walls.

Figure 11:
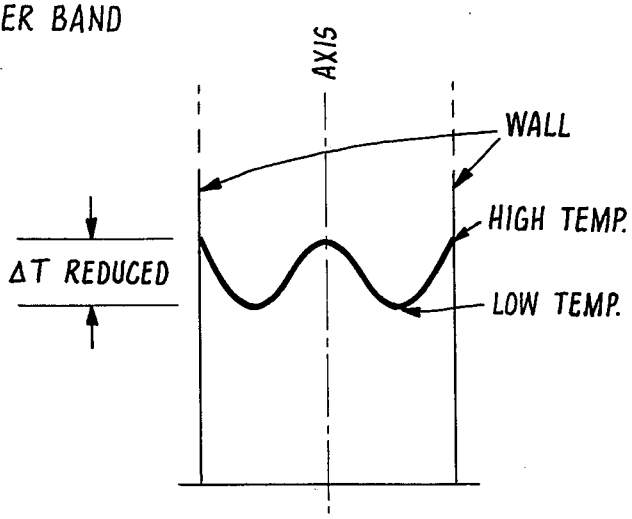
FIG. 11 is a temperature profile of the fluid in the conduit of FIG. 9 subsequent to its passage through an element as in FIGS. 1 or 2.
Figure 12:
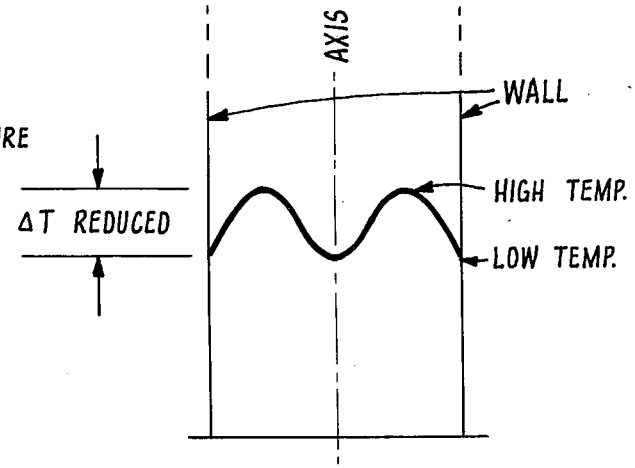
FIG. 12 is a temperature profile of the fluid at the same place as in FIG. 11, but at right angles to that of FIG. 11.

The element of the present invention alters the velocity distribution across the pipe, thereby improving the temperature profile. As shown in FIGS. 11 and 12, the temperature variation (ΔT) is substantially reduced (the same relative scale is used in FIGS. 10, 11, and 12).

In view of the foregoing, modifications to the disclosed embodiments within the spirit of the invention will be apparent to those of ordinary skill in the art. The scope of the invention is therefore to be limited only by the appended claims.

I claim:

1. An element for use in stationary material distribution apparatus, comprising an article of manufacture having a flat generally rectangular central portion having first and second sets of ears affixed to opposite sides of said central portion, said sets of ears including first and second ears bent respectively in upward and downward directions relative to the plane of said central portion, each pair of ears located diagonally opposite one another across said central portion being bent in the same direction relative to the plane of said central portion.

2. The combination of claim 1 further comprising a conduit in which said article is fitted.

3. The combination of claim 2 wherein the ears of said article are curved to fit within a right circular cylindrical conduit and said conduit is right circular cylindrical.

* * * * *